United States Patent [19]

Davis, Jr.

[11] 4,376,498

[45] Mar. 15, 1983

[54] HAND-HELD PNEUMATIC CAULKING GUN

[76] Inventor: George B. Davis, Jr., 7512 Marbury Rd., Bethesda, Md. 20034

[21] Appl. No.: 193,122

[22] Filed: Oct. 2, 1980

[51] Int. Cl.[3] ..... B67D 5/46

[52] U.S. Cl. ..... 222/326; 222/334; 222/389

[58] Field of Search ..... 222/325–327, 222/334, 333, 391, 389, 378

[56] References Cited

U.S. PATENT DOCUMENTS

| | | | |
|---|---|---|---|
| 2,692,706 | 10/1954 | Wiksten | 222/326 |
| 3,568,892 | 3/1971 | Burk | 222/327 |
| 3,997,085 | 12/1976 | Lindquist | 222/391 X |

FOREIGN PATENT DOCUMENTS

| | | | |
|---|---|---|---|
| 154423 | 8/1952 | Australia | 222/389 |

*Primary Examiner*—Charles A. Marmor

[57] ABSTRACT

A hand-held pneumatic caulking gun wherein self-contained pneumatic pressure is continuously applied to the caulk driving piston of the gun while the piston is held against movement by this pressure until manually released by a piston movement controlling trigger. The gun further includes a breaking system whereby the rate of movement of the piston, after its release by the trigger, may be selectively regulated. The gun provides that the pneumatic pressure operative to drive the piston forward and toward its caulk driving position may be redirected as required to return the piston to its retracted or initial position. Additionally is included apparatus for manually driving the piston backwards against its driving pressure as required to release piston pressure upon the caulking being dispensed.

30 Claims, 13 Drawing Figures

HAND-HELD PNEUMATIC CAULKING GUN

The present invention is a hand-held pneumatic caulking gun wherein the pneumatic pressure, operative to drive a caulk driving piston through the gun, is continuously applied to the piston and wherein piston gripping means physically hold the piston from movement against the caulking until manually freed by a piston releasing trigger. Movement of the trigger in releasing the piston, further operates a breaking mechanism that selectively regulates the rate the piston may advance after release and therefore regulates the rate at which caulking is driven from the gun.

Upon completion of a caulking step and therefore to prevent the normally slow dribble of caulking from the cartridge nozzle as the result of a continuing piston pressure upon the caulking within the cartridge, the gun includes means for manually forcing the piston backwards against the driving pressure within its pneumatic system and thereby to relieve this pressure upon the caulking as required to stop further dribble of caulking from the nozzle.

When it is required to return the piston to its initial or retracted position upon the completion of a caulking operation as by the emptying of the cartridge, a valving structure within the gun is operative to redirect the pneumatic piston driving pressure as required to forcefully return the piston to its initial or retracted position.

It is an object of the present invention to provide a pneumatic caulking gun wherein a piston is caused to be pneumatically driven through the caulk containing receptacle of the gun by pneumatic pressure contained within the gun and in a manner to force caulking from the gun in a smoothly controlled and manually regulated manner.

A further object is to provide a pneumatically driven caulking gun wherein the pneumatic pressure is continuously applied to the base of the caulk driving piston of the gun and wherein piston movement against the caulking is regulated and controlled by selectively releasing the piston from a held position against this continuously applied pressure.

A still further object is to provide a hand-held pneumatic caulking gun wherein a manually controlled breaking system within the gun selectively regulates the rate the caulk driving piston is allowed to advance against the caulking after being released from its held position.

An additional object is to provide a hand-held pneumatic caulking gun wherein the pneumatically driven caulk driving piston of the gun may be manually driven backwards against this driving pneumatic pressure for releaving piston pressure upon the caulking being dispensed.

Another object is to provide that a portion of the pneumatic pressure, operative in driving caulking from the gun, is retained within the gun and operable to forcefully retract the piston from its driven to its initial or retracted position.

A further object is to provide within the gun a pressure relief valve that is pre-set to discharge any pressure within the gun in excess of that desired to operate the gun and beyond the structural limitations of the gun.

A still further object is to prevent pneumatic charging of the gun from an external pressure supply source without a pressure relief valve within the gun being connected within its pressure system.

A still further object is to provide a pneumatic driven caulking gun wherein the piston driving pressure source is not necessarily connected to the gun and that such driving pressure, as applied to the piston, is not discharged from the gun each time the trigger of the gun is released.

Another object is to provide a compact pneumatically driven caulking gun wherein in addition to the piston driving receptacle behind the piston the gun further includes a second receptacle in fluid communication with the piston driving receptacle and operative to assist in driving the piston while further operating to return the piston to its initial or retracted position upon completion of a caulking driving stroke of the piston.

A further object is to provide a pneumatic caulking gun that is rugged and reliable in structure yet light in weight for easy handling and operable while free of an attached power supply source.

Other objects and advantages will become more apparent when referring to the accompanying description and drawings wherein.

Figures 1, 2, 3, 4, 9, 10, 11, 12, 13:
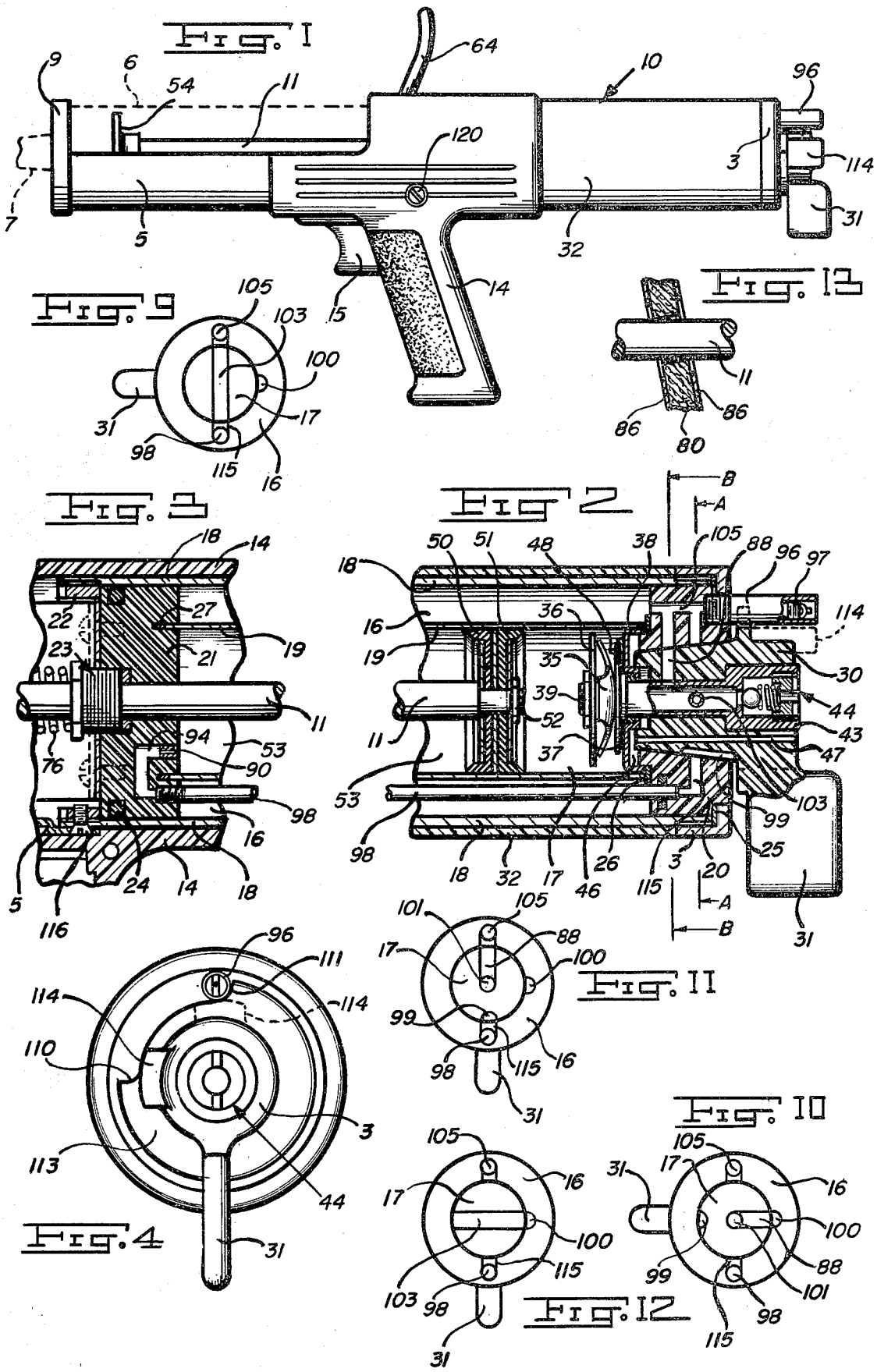
FIG. 1 is a side view in elevation of the pneumatic caulking gun of the present invention.
FIG. 2 is a fragmentary view in section of the after end of the gun and as showing the valving structure therein.
FIG. 3 is a fragmentary view in section of the forward cap as closing the pressure receptacles of the gun.
FIG. 4 is an end view in elevation of the after portion of the gun and as showing the valve control handle in its gun operating or caulk driving position.
FIG. 9 is a diagrammatic view as from the rear of the gun and as taken through the valve along section A—A of FIG. 2 with the valve rotated to its piston retracting position.
FIG. 10 is a diagrammatic view as from the rear of the gun and as taken through the valve along section line B—B of FIG. 2 with the valve rotated to its piston retracting position.
FIG. 11 is a diagrammatic view as from the rear of the gun and as taken through the valve along section line B—B of FIG. 2 with the valve in gun operating or piston driving position.
FIG. 12 is a diagrammatic view as from the rear of the gun as taken through the valve along section line A—A of FIG. 2 with the valve in gun operating or piston driving position.
FIG. 13 is a sectional view showing the piston extending through the braking strip.
Figure 8:
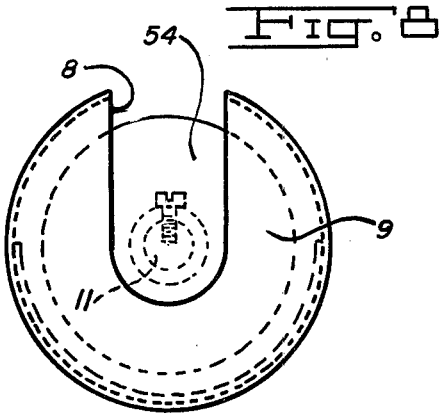
FIG. 8 is an end view in elevation of the forward end plate of the gun.

Referring now to the drawings and particularly to FIG. 1 thereof wherein is shown the caulking gun of the present invention as in side view elevation and including a receptacle portion 5 wherein is shown mounted a conventional caulk containing cartridge 6. The caulk dispensing nozzle 7 of the cartridge is shown as extending through a notch 8 formed in the forward plate 9 of the gun as illustrated to advantage in FIG. 8. Secured to and forming an integral part of the receptacle 5 is the pneumatic piston driving portion of the gun as will be generally designated 10 and operative, during operation of the gun, to drive a piston 11 through the cartridge as required to force caulking from the cartridge nozzle 7.

Figure 6:
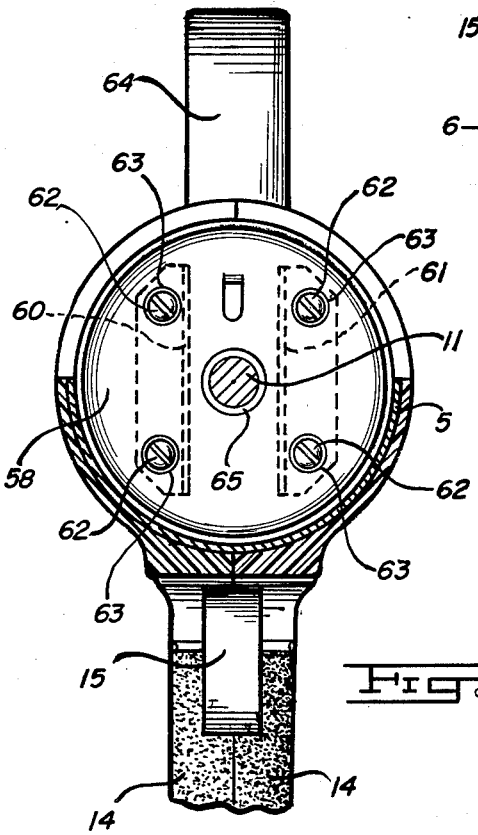
FIG. 6 is a sectional view of the gun as taken along section line 6—6 of FIG. 5.

Supporting the gun mechanism is a handle 14 formed preferably as a clam-shell type plastic molding that is secured about the gun as shown in FIG. 6 and that includes the gun's trigger 15.

FIGS. 2 and 3 show in fragmentary cross-section the pneumatic mechanism of the gun that operates to drive the piston through the gun. This pressure system includes compartments 16 and 17 and as formed by cylindrical tubular sections 18 and 19 respectively. These cylinders are shown as commonly closed by cap pieces 21 and 20 that are clamped in place, respectively, by ring screw 22 and threaded cap ring 3. Suitable seals such as a gland assembly 23 about the piston, the "O" ring 24 and sealing gaskets rings 25, 26 and 27 combine to, pressure wise, isolate compartments 16 and 17 from each other as well as from the external atmosphere about the gun.

The tapered close-fitting valve plug 30, preferably ground into seated position within cap 20, is rotated to its two valving positions within the cap by handle 31. Positioning of the valve by handle 31 operates to control fluid flow throughout the pressure system of the gun, as will hereafter be described. The caps 20 and 21 as well as the valve plug 30 are preferably molded from plastic for lightness while tubular sections 18 and 19 are formed from thin steel or from aluminum of a thickness found suitable for the purpose. A plastic sleeve 32 preferably of some color and closely telescoped over tube 18, operates to protect the surface of the tube from damage.

The closely fitting tapered valve plug 30 is forcefully drawn into and maintained in its shown seated position within cap 20 as by a spider spring washer 35 as the washer is compressed between washers 36, 37 and 38 as nut 39 is tightened. This nut 39 is threaded over the end of a metallic tubular insert 43 preferably molded within the valve plug 30 as shown and includes a pressure relief valve assembly generally designated 44. The cupped washer 38 is positioned to straddle the base of the valve plug 30 and is compressed by spring washer 35 into pressure sealing relation against the sealing washer 26. This arrangement operates to apply the spring load from washer 38 outwardly to the surface of cap 20 as the valve plug is yieldably drawn by nut 29 into its seated position within the cap. This cap and valve assembly may be pressure tested before assembly within the gun.

Tightening of nut 39 further operates to compress, between washers 37 and 38, a composition gland or sealing washer as shown to provide a pressure seal about the tubular insert 43 and thereby pressure isolate the area 46 beneath the valve plug 30 from pressure within compartment 17. Any pressure from leakage that could accumulate beneath the valve plug and within this area 46 and that could operate to forcefully lift the valve plug from its seated position within the cap, is bled to the atmosphere by way of passage 47 extending through the valve plug as shown.

To prevent the gland washer or seal between washers 37 and 38 from rotating with spring 35, a tab 48 secured to and extending from washer 38, is positioned to engage and lock with a hole or notch formed within washer 37 thereby operatively securing these washers 37 and 38 together and fixed against rotation with the valve plug by handle 31.

The caulk driving piston of the gun includes a pair of neophrene or similar rubber cup pieces 50 and 51 that preferably are formed as shown and clamped between suitable washers as nut 52 is tightened. These rubber cups upon the piston operate to isolate compartments 17 and 53 while providing the surfaces against which pressure is applied to the piston for driving the piston in both directions through the gun during a gun operating cycle. A plate 54, secured to the free end of the piston 11, drives caulking from the cartridge 6 as the piston is driven forwardly through the gun during gun operation.

Figure 5:
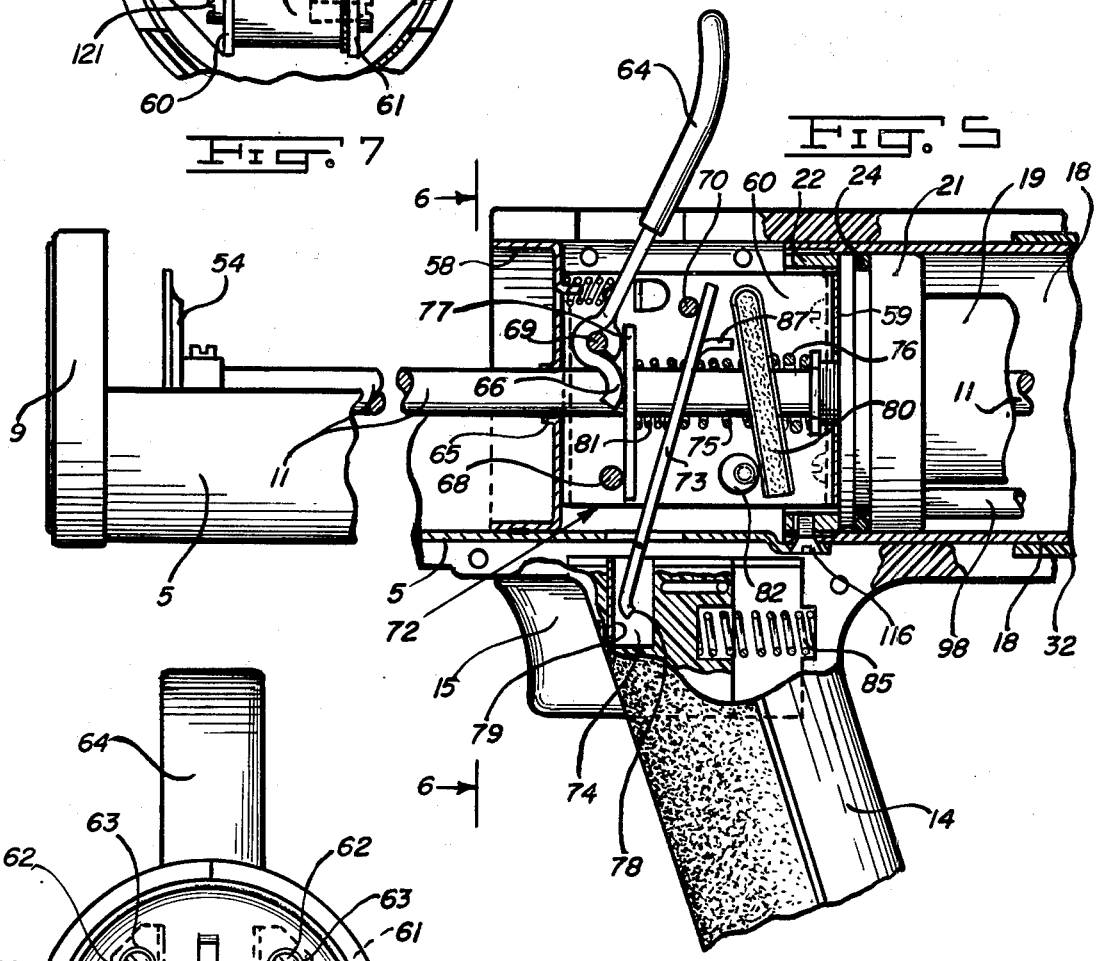
FIG. 5 is a view partly in elevation and partly in sectional cut-away and showing the forward portion of the gun including the handle and piston holding and release mechanism of the gun.

Forward movement of the piston, as driven by pressure within compartments 16 and 17, is controlled by means of a release mechanism positioned within the gun as shown in FIG. 5. This mechanism includes a metallic sheet-metal frame that is comprised of two circular end plates 58 and 59 secured together by side plates 60 and 61. These end and side plates are preferably spot welded together to form the frame 72. As assembled, this frame is fastened to cap 21 by screws 62 that are tightened in place by way of access holes 63 provided within the forward plate 58. The piston 11, as extending through the frame, is supported by a guide flange 65 within plate 58.

Extending between plates 60 and 61 are pins 68 and 70 that, desirably, are in the form of shouldered rivets that, in addition to their function within the mechanism of the gun, operate to stiffen and make more rigid the frame structure 72.

A piston holding plate 73 and through which the piston 11 extends, projects downward and into a recess 74 provided therefor within the gun's trigger 15 and is so maintained in this shown tilted position as by spring 75 that is less stiff than spring 76. This piston holding plate 73 bears against and pivots about pin 70 when backwardly driven by backward movement of the trigger.

With plate 73 in the tilted position shown, it will be noted that the lower end 78 of the plate is slightly clear of the metallic bearing plate 79 within the trigger. This permits a full and free tilting of plate 73 as required to positively grip the piston in a manner to effectively hold the piston against any forward movement as driven by pressure from within the pneumatic system of the gun.

Figure 7:
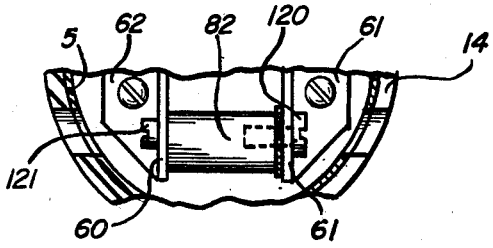
FIG. 7 is a fragmentary view partly in elevation of the breaking plate adjustment cam as mounted in the gun frame.

Also yieldably restraining the piston 11 from forward movement is a composition breaking strip 80 that is preferably formed from a suitable break or clutch material and as bonded between supporting metallic plates 86, FIG. 13. This braking plate or strip 80 pivots about an adjustable cam surface 82, as shown in FIG. 7, and is maintained in a yieldable gripping relation with the piston by stiff spring 76. Here, if desired, a double spring may be applied as to its free end of plate 80 to increase its breaking action upon the piston. With the trigger 15 extended forward and as so held by its return spring 85, both plates 73 and 80 are now in their tilted and piston holding position thereby preventing forward movement of the piston through the gun even though the gun may be fully charged to say a piston driving pressure of 150 psig.

To operate the release mechanism and thereby to effect a forward movement of the piston through the gun in a manner to drive caulking from the cartridge 6, the trigger 15 is manually drawn backwards and into engagement with the extending end 78 of plate 73. Further backward movement of the trigger, forces the plate free of its gripping relation with the piston. The piston, now free of plate 73, will have a tendency to creep forward through the breaking plate 80 towards its caulk driving position. To cause a more rapid and regulated advance of the piston, the trigger is further depressed as required to move the tab 87 upon the plate 73 gradually against the breaking plate 80 and thereby gradually decrease the braking action of this plate upon the piston shaft. Here, the composition and thickness of the breaking plate, the stiffness of spring 76 and the rate of gradual movement of the tab 87 against the braking plate will combine to effectively regulate the rate the piston is allowed to advance against the caulking and therefore the rate caulking is driven from the cartridge nozzle 7.

In order to prevent damage to either the piston or gun should the trigger be depressed with the gun fully charged and no cartridge within the receptacle 7, a restricting orifice 90 is positioned within passage 94 as shown and operates to restrict and thereby closely regulate the flow of gaseous pressure allowed to enter or leave compartment 53 and thereby control and regulate the rate the piston can be driven through the gun either towards its caulk driving position or towards its retracted position.

Before entering further into the operation of the gun, it is believed advantageous to understand the structure and function of the valve plug 30 as positioned within the gun's pressure system. FIGS. 11 and 12 shows in diagrammatic form, the fluid passages through the valve as taken along section line B—B and A—A respectively and as viewed from the rear of the gun and with the valve handle in its down position. FIGS. 9 and 10 show in diagrammatic form the fluid passages through the valve as taken along section lines A—A and B—B respectively and as viewed from the rear of the gun with the valve handle in its side position.

For the purpose of description in FIGS. 9, 10, 11 and 12, the numeral 16 shall be understood to represent compartment 16 as shown in FIG. 2. The numeral 17 shall represent the compartment 17 in FIG. 2. The position of the valve plug within cap 20 shall be represented by the position of the valve handle 31. With the handle in its down position, the valve is in its gun operating or piston driving position. With the handle in its side position the valve is in its piston retraction position. In all FIGS. 105 shall represent the tubular passage from the filling tube 96 and charging valve 97 and by way of which gaseous pressure is admitted to compartments 16 and 17 through passages 105, 88 and 101. In all FIGS. 98 shall be understood to represent the fluid passage through the tubular member 98 that connects with compartment 53 and that fluidly connects compartment 53 with notch 99 by way of passage 115 when the handle is in down or gun operating position.

Numeral 99 is a fluid passing notch as formed within the side of the valve plug 30 while 100 is a similar notch in the side wall of the valve socket within the cap piece 20. Both notches are pressure exhaust passages from the pressure system of the gun to the atmosphere. The numeral 101 represents the tubular passage into compartment 17 as through the center of the valve plug as provided by the metallic insert 43 and operative to connect the fluid system of the gun with the pressure relief valve assembly 44. The passage 88 extends only from the outer edge of the valve plug inwardly to its central passage 101.

With the handle 31 in its down or gun operating position, pressure is applied to compartments 16 and 17 by way of the filling passages 105, 88 and 101. Compartment 53 is now connected to the atmosphere by way of the tubular member 98 and notch 99 formed in the valve plug as shown. The gun is preferably charged to an operating pressure of say 150 psig. Compressed nitrogen has been found suitable for the purpose. When fully charged, the relief valve 44 will open to prevent further gas being admitted to the gun's pressure system. Regulated release of the piston for movement through the gun as from pressure within compartments 16 and 17 and as now controlled by the degree of manual movement of the piston release trigger 15 as hereinbefore described.

As apparent from the valving structure shown, at no time after once charging, is pressure discharged completely from compartment 16 to a zero state. This pressure, after returning the piston, will remain in the gun to assist in recharging the gun for a following gun operation. By proper design, there should be less than $\frac{1}{3}$ pressure drop within the gun's pressure system after driving the piston a full forward caulk-driving stroke.

Upon the completion of a piston stroke through the gun and it is desired to return the piston to its initial or retracted position for replacing the caulking cartridge for example, the valve handle 31 is rotated to its side position as shown in FIGS. 9 and 10 whereupon the pressure within compartment 17 is now discharged to the atmosphere by way of 101, 88 and 100 as pressure from compartment 16 is directed, by way of the cross passage 105, 103 and 98 into compartment 53. Pressure from compartment 16, directed in this manner, forcefully returns the piston from its forward to its retracted position.

The stop 110 and 111 upon the valve flange 113, FIG. 4, operates to limit rotation of the valve plug to its piston driving and piston retraction positions. A standoff lug 114 upon the flange 113, will move against the filling tube 96, as shown in FIG. 2, when the handle 31 is rotated to a side or piston retract position. This prevents a filling nozzle from an external pressure source being applied to the filling tube during such time as compartment 16 is out of fluid circuit with the pressure relief valve 44.

During a caulk dispensing operation, there is a pressure buildup within the caulking cartridge whereby after trigger 15 is released, this pressure is relieved as a slow dribble of caulking from the cartridge nozzle 7. To instantly relieve this pressure and stop this dribble, the gun includes a piston retract lever 64 that pivots about pin 69 and includes a short cam extension 66. As the lever is manually forced forward, this cam surface moves against plate 77, that is normally held vertical and free of the piston shaft 11 by spring 81. Movement of the cam surface 66 against the plate tilts the plate 77 into gripping relation with the piston. Further forward movement of the lever 64, forces the piston backwards through the holding plate 73 that operates to instantly hold the piston in its now retracted position. In this manner piston pressure is released from the caulking within the cartridge and consequently further dribble from its nozzle is stopped.

While herein is shown the breaking plate 80 as manually operable from its tilted and piston breaking position to a piston release position, it is understood that this breaking action of plate 80 may be applied in a reverse manner even though less desirable. For example, after piston release from the holding plate 73, the piston breaking action may be applied manually as by the trigger 15. With such a structure, the breaking plate 80 may be normally maintained in a vertical and piston free position and thereafter tilted backward manually by the trigger to piston breaking position. With such a structure the trigger should be extended to form a lever type member for a more forceful gripping.

While it is understood that there will be a degree of leakage from the gun after charging, the time generally required to empty a caulking cartridge is approximately four to five minutes. The driving pressure within the gun may easily be maintained for well over 30 minutes. Should the pressure within the gun drop below the desired operating pressure following a delay in gun operation, it merely requires that the pressure charging source be momentarily applied to the filling tube 96 of the gun to bring the gun's pressure system again to a fully charged state.

Further, while herein is shown a pneumatic caulking gun that has been found light, rugged and reliable in operation, it is understood that various modifications and arrangement of its components may be resorted to without departing from the inventive concept as here presented.

What I claim and desire to cover by Letters Patent is:

1. A hand-held pneumatic caulking gun including in combination, a receptacle for receiving therein a caulk containing cartridge having a caulk dispensing nozzle thereon, a piston movable when driven from a retracted position to a forward position within said cartridge to force caulking from said nozzle, driving means for said piston including means for applying a continuous pneumatic pressure to a surface of said piston to cause movement of the piston through said cartridge to force caulking from said nozzle, manually releasable holding means for holding said piston against movement by said pneumatic pressure towards its forward position, piston release means manually operable to release the holding means from holding the piston, and valving means operable to redirect piston driving pneumatic pressure to return said piston to a retracted position.

2. A pneumatic caulking gun as called for in claim 1 wherein said means for applying a continuous pneumatic pressure to said piston includes at least two pressure retainable compartments.

3. A pneumatic caulking gun as called for in claim 2 wherein fluid communicating means fluidly connect the said compartments together.

4. A pneumatic caulking gun as called for in claim 3 wherein said valving means is included within said fluid communicating means connecting said compartments.

5. A pneumatic caulking gun as called for in claim 1 wherein said piston holding means includes a tilted holding plate through which the piston extends.

6. A pneumatic caulking gun as called for in claim 5 wherein said tilted holding plate may be manually straightened from its tilted position by the release means to release the piston from a held position.

7. A pneumatic caulking gun as called for in claim 1 wherein manually operable braking means regulates the rate of piston movement towards its caulk driving direction after the piston is released from said holding means.

8. A pneumatic caulking gun as called for in claim 1 wherein pneumatic damping means reduces the rate of movement of the piston as it is pneumatically driven towards its forward portion or its retracted position.

9. A pneumatic caulking gun as called for in claim 1 wherein piston gripping means is manually operable to grip and force the piston backwards towards a retracted position and against the said continuously applied piston driving pneumatic pressure.

10. A pneumatic caulking gun as called for in claim 9 wherein said holding means operates to hold the piston in its backwardly forced portion.

11. A hand-held pneumatic caulking gun including in combination, a receptacle for receiving therein a caulk containing cartridge having a caulk dispensing nozzle thereon, a piston movable when driven from a retracted position to a forward position within said cartridge to force the caulking therein from said nozzle, compartment means for containing a gaseous fluid under pressure and including means operable during a caulk dispensing operation, to apply a continuous gaseous pressure to a surface of said piston thereby tending to drive said piston from a retracted position to a forward position within said cartridge as caulk is forced from said nozzle, piston holding means movable to hold said piston against movement by said gaseous pressure, piston release means manually operable to release said piston from said holding means, and manually controlled valving means operable to redirect said fluid pressure from said compartment means to return said piston from a forwardly driven to a retracted position.

12. A pneumatic caulking gun as called for in claim 11 wherein said compartment means include at least two pressure isolable sections.

13. A pneumatic caulking gun as called for in claim 12 wherein a fluid passage connects the said compartment sections together.

14. A pneumatic caulking gun as called for in claim 13 wherein a said valve is interpositioned in said fluid passage connecting said compartment sections together.

15. A pneumatic caulking gun as called for in claim 11 wherein said piston holding means is in the form of a tilted plate through which the piston extends.

16. A pneumatic caulking gun as it is called for in claim 11 wherein pneumatic damping means reduces the rate of movement of the piston as it is pneumatically driven towards its forward position and towards its retracted position.

17. A pneumatic caulking gun as called for in claim 11 wherein piston gripping means is manually operable to grip and force the piston backwards toward its retracted position and against the said continuously applied gaseous piston driving pressure.

18. A pneumatic caulking gun as called for in claim 15 wherein said tilted holding plate may be manually straightened by the release means to release the piston from its held position.

19. A pneumatic caulking gun as called for in claim 11 wherein manually operable braking means operatively regulates the rate of piston movement towards a caulk driving position after its release from said piston holding means.

20. A pneumatic caulking gun as called for in claim 17 wherein said piston holding means operates to hold the piston in its backwardly forced position.

21. A hand-held pneumatic caulking gun including in combination, a receptacle for receiving therein a caulk containing cartridge having a caulk dispensing nozzle thereon, a piston movable from a retracted position to a forward position within said cartridge to force caulking therein from said nozzle, means forming a compartment in said gun for containing a gaseous fluid under pressure and operable, during a caulk dispensing operation to continuously apply a pressurized gas to a surface of said piston for driving said piston toward a forward position, piston holding means movable to hold said piston against said gaseous pressure, manually movable release means for releasing said piston from said holding means and including means for regulating the rate of piston movement after release from said holding means, and manually operable valving means movable to redirect pressurized gas from said compartment means as required to return said piston from a driven to a retracted position.

22. A pneumatic caulking gun as called for in claim 21 wherein said means for containing said gaseous pressure for driving said piston includes at least two isolable compartments.

23. A pneumatic caulking gun as called for in claim 22 wherein fluid communicating means fluidly connect the said compartments together.

24. A pneumatic caulking gun as called for in claim 23 wherein said valve means is interpositioned in said fluid communicating means connecting said compartments.

25. A pneumatic caulking gun as called for in claim 21 wherein said piston holding means includes a tilted holding plate through which the piston extends.

26. A pneumatic caulking gun as called for in claim 25 wherein the said tilted holding plate may be manually straightened from its tilted position to by the release means to release the piston from its held position.

27. A pneumatic caulking gun as called for in claim 21 wherein manually operable braking means operatively regulates the rate of piston movement towards a caulk driving direction after release from said piston holding means.

28. A pneumatic caulking gun as called for in claim 21 wherein pneumatic damping means reduces the rate of movement of the piston as it is pneumatically driven towards its forward position and towards its retracted position.

29. A pneumatic caulking gun as called for in claim 21 wherein piston gripping means is manually operable to grip and force the piston backward towards a retracted position and against the said continuously applied gaseous pressure operative to drive the piston towards its caulk driving direction of movement.

30. A pneumatic caulking gun as called for in claim 29 wherein said piston holding means operates to hold the piston in its backwardly forced portion.

* * * * *